US010537193B1

(12) United States Patent
Cayler

(10) Patent No.: US 10,537,193 B1
(45) Date of Patent: Jan. 21, 2020

(54) HEAD REST DEVICE

(71) Applicant: Kenneth Cayler, San Diego, CA (US)

(72) Inventor: Kenneth Cayler, San Diego, CA (US)

( * ) Notice: Subject to any disclaimer, the term of this patent is extended or adjusted under 35 U.S.C. 154(b) by 0 days.

(21) Appl. No.: 16/174,370

(22) Filed: Oct. 30, 2018

(51) Int. Cl.
*A47G 9/10* (2006.01)
*A47B 23/04* (2006.01)

(52) U.S. Cl.
CPC ..... *A47G 9/1045* (2013.01); *A47B 23/042* (2013.01); *A47G 9/1063* (2013.01); *A47G 2009/1018* (2013.01)

(58) Field of Classification Search
CPC ..... A47G 9/1045; A47G 9/1063; A47G 2009/1018; A47B 23/042
USPC ..... 248/118, 118.3, 118.5, 441.1
See application file for complete search history.

(56) References Cited

U.S. PATENT DOCUMENTS 4,730,801 A * 3/1988 Cloward ..... A61G 13/12 248/118
5,645,319 A * 7/1997 Parks, Jr. ..... A47C 7/383 297/146
D628,845 S 12/2010 Guner
8,914,926 B2 12/2014 Berhanu
8,925,721 B2 1/2015 Young
9,131,792 B1 * 9/2015 Wagner ..... A47G 9/1063
9,968,198 B2 * 5/2018 Hauer ..... A47C 7/383
2005/0072893 A1 4/2005 Brown
2008/0289110 A1 11/2008 Duterte, Jr.
2013/0276236 A1 * 10/2013 Rasmussen ..... A47G 9/1027 5/640
2015/0107025 A1 * 4/2015 Dauphin ..... A47C 7/383 5/638
2015/0164251 A1 6/2015 Hsu
2019/0069698 A1 * 3/2019 Lin ..... A47G 9/1081
2019/0282007 A1 * 9/2019 Wagner ..... A47C 7/383

FOREIGN PATENT DOCUMENTS

WO 2016151578 2/2017

* cited by examiner

*Primary Examiner* — Muhammad Ijaz

(57) ABSTRACT

The head rest device is a cushion. The head rest device is configured to cushion the head of a person in a face-down position. The head rest device further provides accommodations to allow the person to insert a plurality of arms into the interior of the head rest device. The head rest device is further configured as a pedestal. The pedestal is a structure configured to support a personal data device in an elevated position relative to the supporting surface on which the head rest device rests. The head rest device comprises a foam curvilinear block.

17 Claims, 4 Drawing Sheets

HEAD REST DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including household and table equipment, more specifically, a pillow for lying face downwards that further comprises limb accommodations. (A47G9/1063)

SUMMARY OF INVENTION

The head rest device is a cushion. The head rest device is configured to cushion the head of a person in a face-down position. The head rest device further provides accommodations to allow the person to insert a plurality of arms into the interior of the head rest device. The head rest device is further configured as a pedestal. The pedestal is a structure configured to support a personal data device in an elevated position relative to the supporting surface on which the head rest device rests. The head rest device comprises a foam curvilinear block.

These together with additional objects, features and advantages of the head rest device will be readily apparent to those of ordinary skill in the art upon reading the following detailed description of the presently preferred, but nonetheless illustrative, embodiments when taken in conjunction with the accompanying drawings.

In this respect, before explaining the current embodiments of the head rest device in detail, it is to be understood that the head rest device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the head rest device.

It is therefore important that the claims be regarded as including such equivalent construction insofar as they do not depart from the spirit and scope of the head rest device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
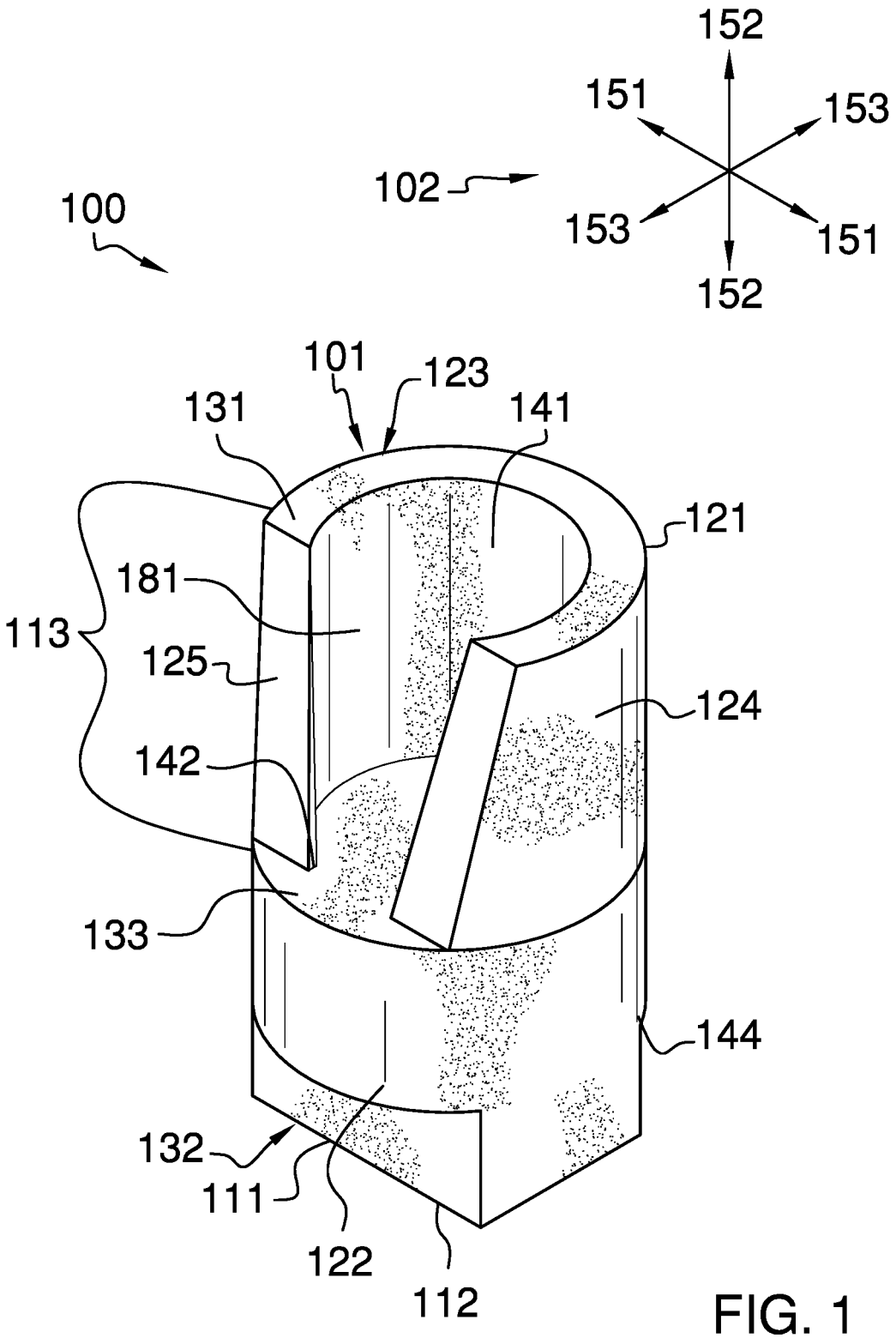
FIG. 1 is a perspective view of an embodiment of the disclosure.
Figure 2:
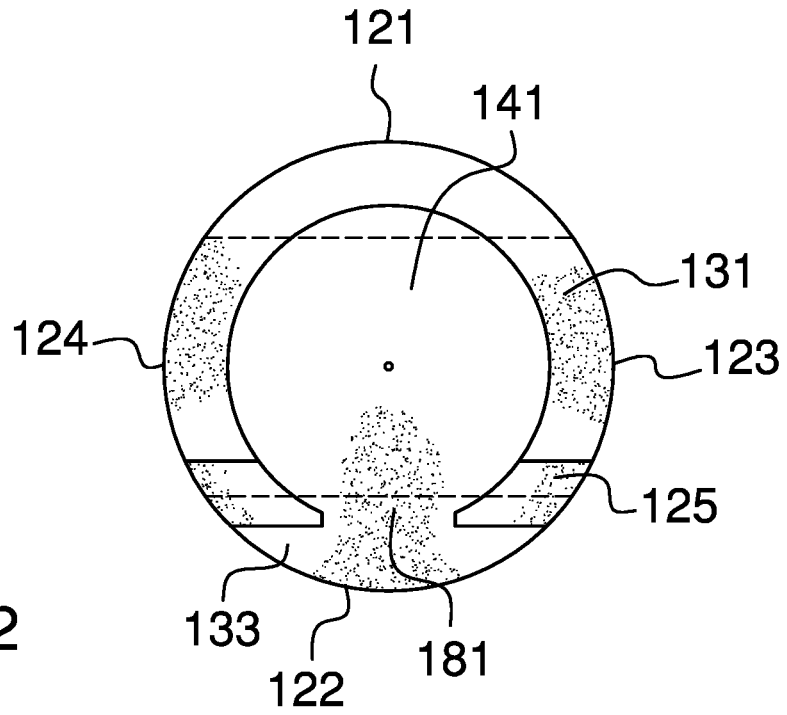
FIG. 2 is a superior view of an embodiment of the disclosure.
Figure 3:
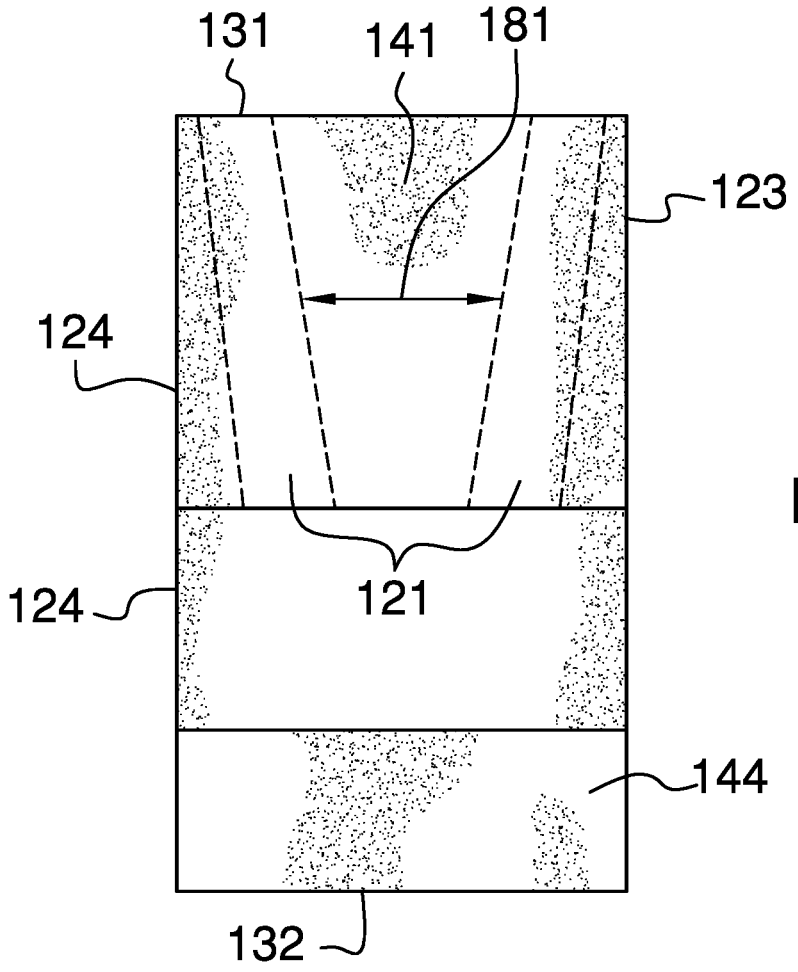
FIG. 3 is an anterior view of an embodiment of the disclosure.
Figure 4:
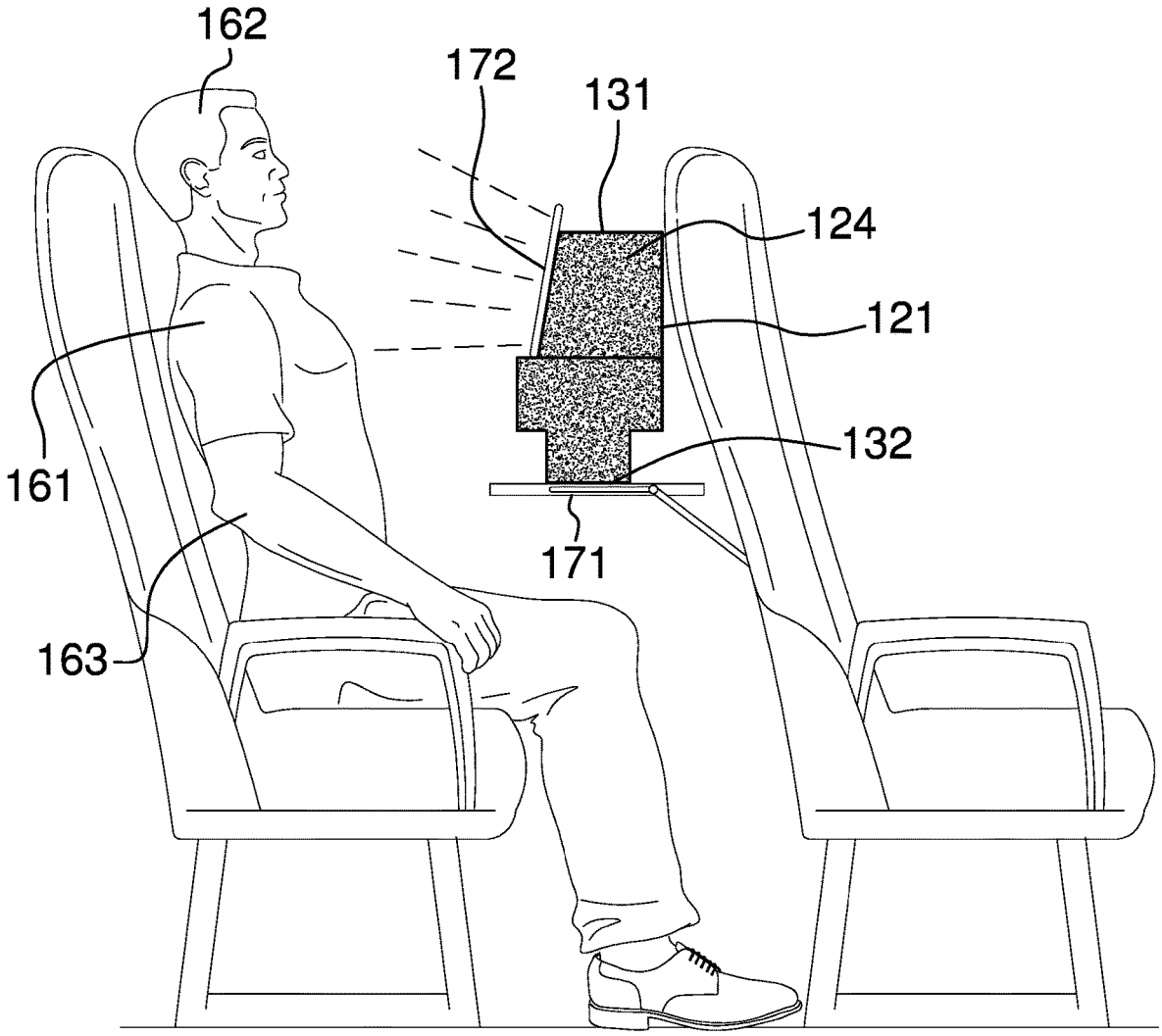
FIG. 4 is an in-use view of an embodiment of the disclosure.
Figure 5:
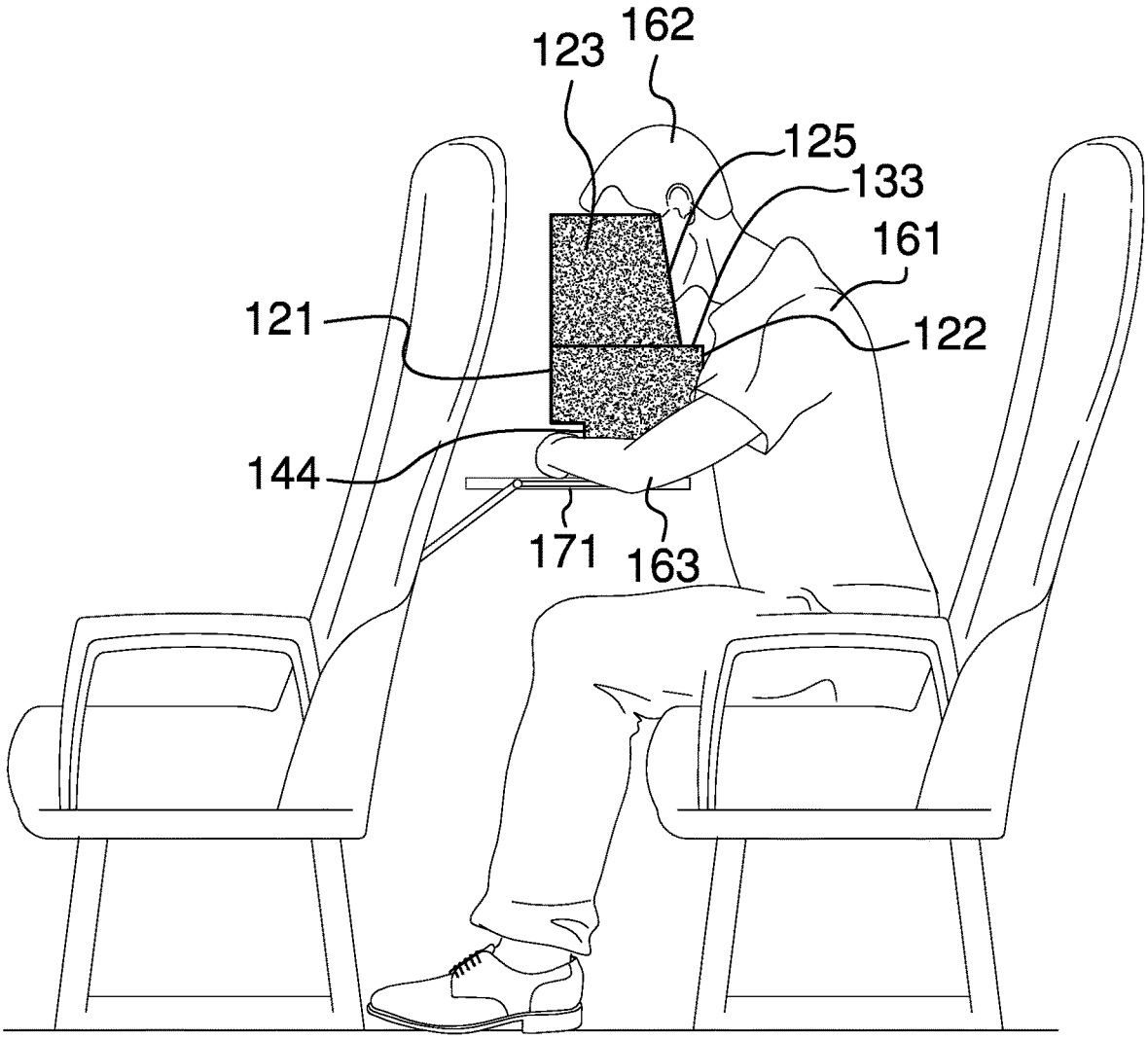
FIG. 5 is an in-use view of an embodiment of the disclosure.

Detailed reference will now be made to one or more potential embodiments of the disclosure, which are illustrated in FIGS. 1 through 5.

The head rest device 100 (hereinafter invention) is a cushion. The invention 100 is configured to cushion the head 162 of a person 161 in a face-down position. The invention 100 further provides accommodations to allow the person 161 to insert a plurality of arms 163 into the interior of the invention 100. The invention 100 is further configured as a pedestal. The pedestal is a structure configured to support a personal data device 172 in an elevated position relative to the supporting surface 171 on which the invention 100 rests. The invention 100 comprises a curvilinear block 101. The person 161 is further defined with a head 162 and a plurality of arms 163.

The personal data device 172 is a programmable electrical device that provides data management and communication services through one or more functions referred to as an application. The application is a set of logical operating instructions that are performed by the personal data device 172. The addition of an application will provide increased functionality for the personal data device 172.

The curvilinear block 101 is a curvilinear block 101 structure. The curvilinear block 101 is the primary structure of the invention 100. The curvilinear block 101 is configured to rest on a supporting surface 171. The curvilinear block 101 is configured for use with a personal data device 172. The curvilinear block 101 forms a pedestal that elevates a personal data device 172 for usage. The curvilinear block 101 is configured for use as a pillow. Specifically, the curvilinear block 101 is configured to cushion the head 162 of the person 161 during a resting period. The curvilinear block 101 is further configured with an accommodation that allows for the insertion of the plurality of arms 163 of the person 161.

The curvilinear block 101 comprises a foam block structure 111. The foam block structure 111 is further defined with a plurality of directions 102. The plurality of directions 102 are used to describe the positions and orientations of the elements of the curvilinear block 101. The plurality of directions 102 comprises a coronal direction 151, a sagittal direction 152, and a transverse direction 153. The coronal direction 151 is defined in greater detail elsewhere in this disclosure. The sagittal direction 152 is defined in greater detail elsewhere in this disclosure. The transverse direction 153 is defined in greater detail elsewhere in this disclosure.

The foam block structure 111 is a semi-rigid structure with an elastic nature. The foam block structure 111 is formed from a polyurethane foam. The foam block structure 111 forms the exterior surfaces of the curvilinear block 101. The foam block structure 111 forms the curvilinear block 101 structure of the curvilinear block 101. The foam block structure 111 comprises a plurality of vertical surfaces 112, a plurality of horizontal surfaces 113, and a plurality of channels 114.

Each of the plurality of vertical surfaces 112 is a surface formed in the foam block structure 111. Each of the plurality of vertical surfaces 112 forms an exterior surface of the curvilinear block 101. Each of the plurality of vertical surfaces 112 is a surface that: a) forms a cant relative to the supporting surface 171 the invention 100 rests on; when, b) the selected vertical surface is in its relaxed shape. The plurality of vertical surfaces 112 comprises an anterior surface 121, a posterior surface 122, a dexter surface 124, a sinister surface 123, and a canted surface 125.

The anterior surface 121 is the face of the foam block structure 111 with the largest surface area. The anterior surface 121 is proximal to the person 161 during a resting period. The anterior surface 121 is perpendicular to the supporting surface 171 on which the foam block structure 111 rests. The anterior surface 121 contains and is bifurcated by a slot 181 formed by the sagittal channel 141. The sagittal channel 141 is described in greater detail elsewhere in this disclosure. The anterior surface 121 has a rectangular shape. The anterior surface 121 forms a planar surface. The anterior surface 121 forms a perpendicular brink with the dexter surface 124. The anterior surface 121 forms a perpendicular brink with the sinister surface 123. The anterior surface 121 forms a perpendicular brink with the superior surface 131. The anterior surface 121 forms a perpendicular brink with the inferior surface 132. The brinks formed by the anterior surface 121 may or may not be rounded.

The posterior surface 122 is the face of the foam block structure 111 that: a) is distal from the anterior surface 121; and, b) is formed at a position inferior to the ledge surface 133. The posterior surface 122 is perpendicular to the supporting surface 171 on which the foam block structure 111 rests. The posterior surface 122 has a rectangular shape. The posterior surface 122 forms a planar surface. The posterior surface 122 forms a perpendicular brink with the dexter surface 124. The posterior surface 122 forms a perpendicular brink with the sinister surface 123. The posterior surface 122 forms a perpendicular brink with the ledge surface 133. The posterior surface 122 forms a perpendicular brink with the inferior surface 132. The brinks formed by the posterior surface 122 may or may not be rounded.

The dexter surface 124 is a face of the foam block structure 111 that is perpendicular to both the anterior surface 121 and the posterior surface 122. The dexter surface 124 forms the dexter side of the foam block structure 111. The dexter surface 124 is perpendicular to the supporting surface 171 on which the foam block structure 111 rests. The dexter surface 124 has a rectangular shape. The dexter surface 124 forms a planar surface. The dexter surface 124 forms a perpendicular brink with the anterior surface 121. The dexter surface 124 forms a perpendicular brink with the posterior surface 122. The dexter surface 124 forms a perpendicular brink with the superior surface 131. The dexter surface 124 forms a perpendicular brink with the inferior surface 132. The dexter surface 124 forms a perpendicular brink with the ledge surface 133. The dexter surface 124 forms a brink with the canted surface 125. The brinks formed by the dexter surface 124 may or may not be rounded.

The sinister surface 123 is a face of the foam block structure 111 that is perpendicular to both the anterior surface 121 and the posterior surface 122. The sinister surface 123 is parallel to the dexter surface 124. The sinister surface 123 is distal from the dexter surface 124. The sinister surface 123 forms the sinister side of the foam block structure 111. The sinister surface 123 is perpendicular to the supporting surface 171 on which the foam block structure 111 rests. The sinister surface 123 has a rectangular shape. The sinister surface 123 forms a planar surface.

The sinister surface 123 forms a perpendicular brink with the anterior surface 121. The sinister surface 123 forms a perpendicular brink with the posterior surface 122. The sinister surface 123 forms a perpendicular brink with the superior surface 131. The sinister surface 123 forms a perpendicular brink with the inferior surface 132. The sinister surface 123 forms a perpendicular brink with the ledge surface 133. The sinister surface 123 forms a brink with the canted surface 125. The brinks formed by the sinister surface 123 may or may not be rounded.

The canted surface 125 has a rectangular shape. The canted surface 125 forms a planar surface. The canted surface 125 is bounded by the dexter surface 124, the superior surface 131, the sinister surface 123 and the ledge surface 133. The canted surface 125 forms a non-perpendicular cant relative to the supporting surface 171. The canted surface 125 forms a backrest on which the personal data device 172 rests when the personal data device 172 is placed on the ledge surface 133. The canted surface 125 is in a superior position relative to the posterior surface 122. The canted surface 125 forms a brink with the dexter surface 124. The canted surface 125 forms a brink with the sinister surface 123. The canted surface 125 forms a brink with the superior surface 131. The canted surface 125 forms a brink with the ledge surface 133. The brinks formed by the canted surface 125 may or may not be rounded.

Each of the plurality of horizontal surfaces 113 is a surface formed in the foam block structure 111. Each of the plurality of horizontal surfaces 113 forms an exterior surface of the curvilinear block 101. Each of the plurality of horizontal surfaces 113 is a surface that: a) parallel to the supporting surface 171 the invention 100 rests on; when, b) the selected horizontal surface is in its relaxed shape. The plurality of horizontal surfaces 113 comprises a superior surface 131, an inferior surface 132, and a ledge surface 133.

The superior surface 131 is the surface of the foam block structure 111 with the highest elevation when the foam block structure 111 rests normally on the supporting surface 171. The superior surface 131 has a rectangular shape. The superior surface 131 is parallel to the supporting surface 171. The superior surface 131 forms a planar surface. The superior surface 131 is parallel to the supporting surface 171. The superior surface 131 forms a perpendicular brink with the anterior surface 121. The superior surface 131 forms a perpendicular brink with the dexter surface 124. The superior surface 131 forms a perpendicular brink with the sinister surface 123. The superior surface 131 forms a brink with the canted surface 125. The brinks formed by the superior surface 131 may or may not be rounded.

The inferior surface 132 is the surface of the foam block structure 111 placed against the supporting surface 171 when the invention 100 is used normally. The inferior surface 132 is distal from the superior surface 131. The inferior surface 132 is parallel to the superior surface 131. The inferior surface 132 has a rectangular shape. The inferior surface 132 forms a planar surface. The inferior surface 132 is parallel to the superior surface 131. The inferior surface 132 forms a perpendicular brink with the anterior surface 121. The inferior surface 132 forms a perpendicular brink with the posterior surface 122. The inferior surface 132 forms a perpendicular brink with the dexter surface 124. The inferior surface 132 forms a perpendicular brink with the sinister surface 123. The brinks formed by the inferior surface 132 may or may not be rounded.

The ledge surface 133 is the surface of the foam block structure 111 with the least surface area. The ledge surface 133 has a rectangular shape. The ledge surface 133 forms a planar surface. The planar surface of the ledge surface 133 is parallel to a transverse plane formed through the foam block structure 111. The ledge surface 133 is parallel to the superior surface 131, the inferior surface 132 and the supporting surface 171. The ledge surface 133 forms a horizontal supporting structure on which the personal data device 172 rests.

The ledge surface 133 forms a perpendicular brink with the posterior surface 122. The ledge surface 133 forms a perpendicular brink with the dexter surface 124. The ledge surface 133 forms a perpendicular brink with the sinister surface 123. The ledge surface 133 forms a brink with the canted surface 125. The ledge surface 133 forms the demarcation between the posterior surface 122 and the canted surface 125. The brinks formed by the ledge surface 133 may or may not be rounded.

Each of the plurality of channels 114 is a negative space formed into the interior of the foam block structure 111. The purpose of each of the plurality of channels 114 is selected from the group consisting of: a) allowing air to flow to the head 162 of the person 161 during a resting period; and, b) providing a space into which the plurality of arms 163 of the person 161 during a resting period. The plurality of channels 114 comprises a sagittal channel 141, a transverse channel 142, a coronal channel 143, and an inferior channel 144.

The sagittal channel 141 is a negative space formed into the interior of the foam block structure 111. The sagittal channel 141 has a prism structure. The center axis of the sagittal channel 141 is parallel to the sagittal direction 152 of the foam block structure 111. The sagittal channel 141 is formed as a pipe segment. The perimeter edges of the pipe segment that forms the sagittal channel 141 intersect with the anterior surface 121 such that a slot 181 is formed in the anterior surface 121. The sagittal channel 141 is formed through the entire structure of the foam block structure 111 from the superior surface 131 to the inferior surface 132. A first end of the pipe segment structure of the sagittal channel 141 forms an opening in the superior surface 131. A second end of the pipe segment structure of the sagittal channel 141 forms an opening in the inferior surface 132. The sagittal channel 141 is sized such that the nose and mouth of the head 162 of the person 161 can fit into the sagittal channel 141.

The transverse channel 142 is a negative space formed into the interior of the foam block structure 111. The transverse channel 142 has a truncated prism structure. The truncated end of the prism structure of the transverse channel 142 is truncated by the canted surface 125. The center axis of the transverse channel 142 is parallel to the transverse direction 153 of the foam block structure 111. The transverse channel 142 is formed in a position superior to the ledge surface 133. A third end of the transverse channel 142 forms an aperture through the canted surface 125. A fourth end of the transverse channel 142 forms an aperture into the sagittal channel 141. The center axis of the transverse channel 142 perpendicularly intersects the center axis of the sagittal channel 141.

The coronal channel 143 is a negative space formed into the interior of the foam block structure 111. The coronal channel 143 has a prism structure. The center axis of the coronal channel 143 is parallel to the coronal direction 151 of the foam block structure 111. The coronal channel 143 is formed through the entire structure of the foam block structure 111 from the dexter surface 124 to the sinister surface 123. The coronal channel 143 is positioned such that the coronal channel 143 passes directly through the sagittal channel 141. A fifth end of the coronal channel 143 forms an aperture through the canted surface 125. A sixth end of the coronal channel 143 forms an aperture into the sagittal channel 141. The center axis of the coronal channel 143 perpendicularly intersects the center axis of the sagittal channel 141.

The inferior channel 144 is a negative space formed into the interior of the foam block structure 111. The inferior channel 144 has a prism structure. The center axis of the inferior channel 144 is parallel to the coronal direction 151 of the foam block structure 111. The inferior channel 144 is formed through the entire structure of the foam block structure 111 from the dexter surface 124 to the sinister surface 123. The inferior channel 144 is positioned such that the inferior channel 144 passes directly through the sagittal channel 141. The inferior channel 144 is formed such that the inferior lateral face of the inferior channel 144 forms an opening in the posterior surface 122. A fifth end of the inferior channel 144 forms an aperture through the canted surface 125. A sixth end of the inferior channel 144 forms an aperture into the sagittal channel 141. The center axis of the inferior channel 144 perpendicularly intersects the center axis of the sagittal channel 141.

The plurality of arms 163 insert into the inferior channel 144.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anterior: As used in this disclosure, anterior is a term that is used to refer to the front side or direction of a structure. When comparing two objects, the anterior object is the object that is closer to the front of the structure.

Backrest: As used in this disclosure, a backrest is a vertical or vertically canted supporting surface.

Brink: As used in this disclosure, a brink refers to the discontinuous edge or line formed by the intersection of a first plane or surface and a second plane or surface wherein a cant exists between the first plane or surface and the second plane or surface.

Cant: As used in this disclosure, a cant is an angular deviation from one or more reference lines (or planes) such as a vertical line (or plane) or a horizontal line (or plane).

Carbamate: As used in this disclosure, a carbamate is a functional group consisting of an O—(C=O)—N structure. Carbamate is informally referred to as urethane.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Channel: As used in this disclosure, a channel is a tubular passage through which an object or fluid is passed through.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object. Always use Geometrically similar, correspond and one to one Copolymer: As used in this disclosure, a copolymer is a polymer formed from two or more repeating molecules (also referred to as monomers).

Coronal Direction: As used in this disclosure, the coronal direction runs from the dexter surface to the sinister surface of an object and is perpendicular to the sagittal direction and the transverse direction Coronal Plane: As used in this disclosure, the coronal plane refers to a reference plane that bisects an anterior surface and posterior surface such that the coronal plane contains the line of the coronal direction and the line of the sagittal direction. The coronal plane is also referred to as the lateral plane. The coronal plane is perpendicular to the sagittal plane and the transverse plane.

Correspond: As used in this disclosure, the term correspond is used as a comparison between two or more objects wherein one or more properties shared by the two or more objects match, agree, or align within acceptable manufacturing tolerances.

Curvilinear Block: As used in this disclosure, a curvilinear block refers to a three-dimensional structure comprising a plurality of rectangular surfaces. Curvilinear blocks are similar to rectangular blocks, but include curves and arcs, and are often used to create a structure with a reduced interior volume relative to a rectangular block. Within this disclosure, a curvilinear block may further comprise rounded edges and corners.

Cushion: As used in this disclosure a cushion is a pad or pillow formed from a soft material that is used for resting, sleeping, or reclining.

Dexter: As used in this disclosure, dexter is a directional reference that refers to the right side of an object from the perspective of a viewer who is facing the posterior side of the object.

Disk: As used in this disclosure, a disk is a prism-shaped object that is flat in appearance. Specifically, the surface area of an end of the prism-shaped object that forms the disk is greater than the lateral face of the prism-shaped object that forms the disk. In this disclosure, the ends of the prism-shaped structure that forms the disk are referred to as the faces of the disk.

Distal: As used in this disclosure, distal refers to a directional sense or location of an object. Specifically, distal refers to a first object, or a side of a first object, that is distal from the medial axis, or more proximal to the side of the object, relative to a second object, or side of a second object.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elevation: As used in this disclosure, elevation refers to the span of the distance in the superior direction between a specified horizontal surface and a reference horizontal surface. Unless the context of the disclosure suggests otherwise, the specified horizontal surface is the supporting surface the potential embodiment of the disclosure rests on. The infinitive form of elevation is to elevate.

Exterior: As used in this disclosure, the exterior is used as a relational term that implies that an object is not contained within the boundary of a structure or a space.

Foam: As used in this disclosure, foam is a mass of gas-filled spaces, commonly referred to as bubbles, which can be formed: 1) on or in a liquid or gel; or, 2) in a solid material.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Headrest: As used in this disclosure, a headrest is a cushion used to support the head of a person.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Lateral: As used in this disclosure, lateral refers to a directional sense or location of an object. Specifically, lateral refers to an object or a side of an object that is proximal to the side or distal from the medial axis of the object. Lateral sides form the boundary of a coronal plane.

Ledge: As used in this disclosure, a ledge is a horizontal surface that projects away from a vertical surface. A ledge that projects away from, or overhangs, the vertical surface in the manner of a cantilever is referred to as an undercut ledge.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Logical Device: As used in this disclosure, a logical device is an electrical device that processes externally provided inputs to generate outputs that are determined from a previously determined logical functions. A logical device may or may not be programmable.

Monomer: As used in this disclosure, a monomer refers to a molecular structure that bonds to itself in a repeating manner to form a polymer.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pad: As used in this disclosure, a pad is a mass of soft material used as a filling or for protection against damage or injury. Commonly used padding materials include, but are not limited to, polyurethane foam, silicone, a polyester fill often referred to as fiberfill or polystyrene beads often referred to as stuffing beans or as bean bag chair beans.

PDD: As used in this disclosure, PDD is an acronym for a personal data device.

Pedestal: As used in this disclosure, a pedestal is an intermediary load bearing structure that that transfers a load path between a supporting surface and an object, structure, or load.

Personal Data Device: As used in this disclosure, a personal data device is a handheld logical device that is used for managing personal information and communication. Examples of personal data device include, but are not limited to, cellular phones, tablets, and smart phones.

Pipe Segment: As used in this disclosure, a pipe segment is a hollow prism structure further formed with a negative space formed in the lateral face of the hollow prism structure. The negative space is formed as a rectangular structure bounded by: 1) the first end and the second end of the hollow prism structure; and 2) a first perimeter edge that is parallel to the center axis of the hollow prism structure; and, 3) a second perimeter edge that is parallel to the center axis of the hollow prism structure. The interior of the hollow prism structure is accessible through the pipe segment. The region of the hollow prism structure that is distal (diametrically opposed) to the negative space is referred to as the spine.

Polymer: As used in this disclosure, a polymer refers to a molecular chain that comprises multiple repeating units known as monomers. The repeating unit may be an atom or a molecular structure.

Polyurethane: As used in this disclosure, a polyurethane is a copolymer wherein the one or more monomer chains are linked together carbamates.

Posterior: As used in this disclosure, posterior is a term that is used to refer to the side of an object that is distal or in the opposite direction of the anterior side. When comparing two items, the posterior item is the item that is distal from the anterior of the object.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Relaxed Shape: As used in this disclosure, a structure is considered to be in its relaxed state when no shear, strain, or torsional forces are being applied to the structure.

Rounded: A used in this disclosure, the term rounded refers to the replacement of an apex, vertex, or edge or brink of a structure with a (generally smooth) curvature wherein the concave portion of the curvature faces the interior or center of the structure.

Sagittal Direction: As used in this disclosure, the sagittal direction runs from the superior surface to the inferior surface of an object and is perpendicular to the coronal direction and the transverse direction.

Sagittal Plane: As used in this disclosure, the sagittal plane refers to a reference plane that bisects a dexter surface and sinister surface such that the sagittal plane contains the line of the coronal direction and the line of the sagittal direction. The sagittal plane is perpendicular to the coronal plane and the transverse plane.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Sinister: As used in this disclosure, sinister is a directional reference that refers to the left side of an object from the perspective of a viewer who is facing the posterior side of the object.

Slot: As used in this disclosure, a slot is a long narrow cut or opening that is formed in or through an object.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Transverse Direction: As used in this disclosure, the transverse direction runs from the anterior surface to the posterior surface of an object and is perpendicular to the coronal direction and the sagittal direction Transverse Plane: As used in this disclosure, the transverse plane refers to a reference plane that bisects a superior surface and inferior surface such that the transverse plane contains the line of the transverse direction and the line of the transverse direction. The transverse plane is perpendicular to the coronal plane and the sagittal plane.

Truncated: As used in this disclosure, a geometric object is truncated when an apex, vertex, or end is cut off by a line or plane.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A multi-purpose cushioning structure comprising:

a curvilinear block;

wherein the multi-purpose cushioning structure is a cushion;

wherein the multi-purpose cushioning structure is configured for use with a personal data device;

wherein the multi-purpose cushioning structure is configured for use with a person;

wherein the multi-purpose cushioning structure is configured to cushion a head of the person in a face-down position;

wherein a pedestal is a structure configured elevates the personal data device relative to a supporting surface on which the multi-purpose cushioning structure rests;

wherein a foam block structure comprises a plurality of vertical surfaces, a plurality of horizontal surfaces, and a plurality of channels;

wherein the plurality of vertical surfaces comprises an anterior surface, a posterior surface, a dexter surface, a sinister surface, and a canted surface;

wherein the anterior surface is distal from the posterior surface;

wherein the dexter surface is distal from the sinister surface;

wherein the canted surface forms a cant relative to the posterior surface;

wherein the curvilinear block is further defined with a superior surface and an inferior surface;

wherein the superior surface of the curvilinear block has linear edges;

wherein the superior surface of the curvilinear block is parallel to the supporting surface;

wherein the superior surface of the curvilinear block forms a planar surface;

wherein the superior surface of the curvilinear block is parallel to the supporting surface;

wherein the superior surface of the curvilinear block forms a perpendicular brink with the anterior surface;

wherein the superior surface of the curvilinear block forms a perpendicular brink with the dexter surface;

wherein the superior surface of the curvilinear block forms a perpendicular brink with the sinister surface;

wherein the superior surface of the curvilinear block forms a brink with the canted surface;

wherein the inferior surface of the curvilinear block is parallel to the superior surface;

wherein the inferior surface of the curvilinear block has a rectangular shape;

wherein the inferior surface of the curvilinear block forms a planar surface;

wherein the inferior surface of the curvilinear block forms a perpendicular brink with the anterior surface;

wherein the inferior surface of the curvilinear block forms a perpendicular brink with the posterior surface;

wherein the inferior surface of the curvilinear block forms a perpendicular brink with the dexter surface;

wherein the inferior surface of the curvilinear block forms a perpendicular brink with the sinister surface.

2. The multi-purpose cushioning structure according to claim 1 wherein the curvilinear block is a curvilinear block structure;

wherein the curvilinear block forms the pedestal that elevates the personal data device for usage;

wherein the curvilinear block is configured to cushion the head of the person;

wherein the curvilinear block is further configured with an accommodation that allows for the insertion of a plurality of arms of the person.

3. The multi-purpose cushioning structure according to claim 2 wherein the foam block structure is a semi-rigid structure;

wherein the foam block structure has an elastic nature;

wherein the foam block structure forms a plurality of exterior surfaces of the curvilinear block.

4. The multi-purpose cushioning structure according to claim 3 wherein each of the plurality of channels is a negative space formed into the interior of the foam block structure;

wherein the purpose of each of the plurality of channels is configured to a) allow air to flow to the head of the person during a resting period or b) providing a space into which the plurality of arms of the person during a resting period.

5. The multi-purpose cushioning structure according to claim 4 wherein each of the plurality of horizontal surfaces is a surface that: a) parallel to the supporting surface the multi-purpose cushioning structure rests on; when, b) the surface of the plurality of horizontal surfaces is in its relaxed shape.

6. The multi-purpose cushioning structure according to claim 5 wherein the anterior surface is a face of the foam block structure with a largest surface area;

wherein the anterior surface is configured to be proximal to the person during a resting period;

wherein the anterior surface is perpendicular to the supporting surface on which the foam block structure rests;

wherein the anterior surface contains and is bifurcated by a slot;

wherein the anterior surface has a rectangular shape;

wherein the anterior surface forms a planar surface;

wherein the anterior surface forms a perpendicular brink with the dexter surface;

wherein the anterior surface forms a perpendicular brink with the sinister surface.

7. The multi-purpose cushioning structure according to claim 6 wherein the posterior surface is a face of the foam block structure that is distal from the anterior surface;

wherein the posterior surface is perpendicular to the supporting surface on which the foam block structure rests;

wherein the posterior surface has a rectangular shape;

wherein the posterior surface forms a planar surface;

wherein the posterior surface forms a perpendicular brink with the dexter surface;

wherein the posterior surface forms a perpendicular brink with the sinister surface;

wherein the posterior surface forms a perpendicular brink with a ledge surface.

8. The multi-purpose cushioning structure according to claim 7 wherein the dexter surface is a face of the foam block structure that is perpendicular to both the anterior surface and the posterior surface;

wherein the dexter surface is perpendicular to the supporting surface on which the foam block structure rests;

wherein the dexter surface has a rectangular shape;

wherein the dexter surface forms a planar surface;

wherein the dexter surface forms a perpendicular brink with the anterior surface;

wherein the dexter surface forms a perpendicular brink with the posterior surface;

wherein the dexter surface forms a perpendicular brink with the ledge surface;

wherein the dexter surface forms a brink with the canted surface;

wherein the sinister surface is a face of the foam block structure that is perpendicular to both the anterior surface and the posterior surface;

wherein the sinister surface is parallel to the dexter surface;

wherein the sinister surface is perpendicular to the supporting surface on which the foam block structure rests;

wherein the sinister surface has a rectangular shape;

wherein the sinister surface forms a planar surface;

wherein the sinister surface forms a perpendicular brink with the anterior surface;

wherein the sinister surface forms a perpendicular brink with the posterior surface;

wherein the sinister surface forms a perpendicular brink with the ledge surface;

wherein the sinister surface forms a brink with the canted surface.

9. The multi-purpose cushioning structure according to claim 8 wherein the canted surface has a rectangular shape;

wherein the canted surface forms a planar surface;

wherein the canted surface is bounded by the dexter surface, the superior surface, the sinister surface, and the ledge surface;

wherein the canted surface forms a non-perpendicular cant relative to the supporting surface;

wherein the canted surface is in a superior position relative to the posterior surface;

wherein the canted surface forms a brink with the dexter surface;

wherein the canted surface forms a brink with the sinister surface;

wherein the canted surface forms a brink with the ledge surface.

10. The multi-purpose cushioning structure according to claim 9 wherein the plurality of horizontal surfaces comprises a superior surface, an inferior surface, and a ledge surface;

wherein the superior surface is the surface of the foam block structure with a highest elevation when the foam block structure rests on the supporting surface;

wherein the inferior surface is distal from the superior surface;

wherein the ledge surface forms a transverse plane positioned between the superior surface and an inferior surface.

11. The multi-purpose cushioning structure according to claim 10 wherein the ledge surface is the surface of the foam block structure with a least surface area;

wherein the ledge surface has a rectangular shape;

wherein the ledge surface forms a horizontal supporting structure on which the personal data device rests;

wherein the ledge surface forms a perpendicular brink with the posterior surface;

wherein the ledge surface forms a perpendicular brink with the dexter surface;

wherein the ledge surface forms a perpendicular brink with the sinister surface;

wherein the ledge surface forms a brink with the canted surface;

wherein the ledge surface forms the demarcation between the posterior surface and the canted surface;

wherein the posterior surface is formed at a position inferior to the ledge surface.

12. The multi-purpose cushioning structure according to claim 11 wherein the plurality of channels comprises a sagittal channel, a transverse channel, a coronal channel, and an inferior channel;

wherein the sagittal channel is perpendicular to the transverse channel, the coronal channel, and the inferior channel;

wherein the transverse channel is perpendicular to the coronal channel, and the inferior channel;

wherein the coronal channel is parallel to the inferior channel wherein a bifurcating slot of the anterior surface is formed by the sagittal channel.

13. The multi-purpose cushioning structure according to claim 12 wherein the sagittal channel has a prism structure;

wherein the sagittal channel is formed as a pipe segment;

wherein a plurality of perimeter edges of the pipe segment that forms the sagittal channel intersect with the anterior surface such that the slot is formed in the anterior surface;

wherein the sagittal channel is formed through the entire structure of the foam block structure from the superior surface to the inferior surface;

wherein a first end of the pipe segment structure of the sagittal channel forms an opening in the superior surface;

wherein a second end of the pipe segment structure of the sagittal channel forms an opening in the inferior surface;

wherein the sagittal channel is sized such that the nose and mouth of the head of the person can fit into the sagittal channel.

14. The multi-purpose cushioning structure according to claim 13 wherein the transverse channel has a truncated prism structure;

wherein a truncated end of the prism structure of the transverse channel is truncated by the canted surface;

wherein a center axis of the transverse channel is parallel to the transverse direction of the foam block structure;

wherein the transverse channel is formed in a position superior to the ledge surface;

wherein a third end of the transverse channel forms an aperture through the canted surface;

wherein a fourth end of the transverse channel forms an aperture into the sagittal channel;

wherein the center axis of the transverse channel perpendicularly intersects the center axis of the sagittal channel.

15. The multi-purpose cushioning structure according to claim 14 wherein the coronal channel has a prism structure;

wherein the center axis of the coronal channel is parallel to the coronal direction of the foam block structure;

wherein the coronal channel is formed through the entire structure of the foam block structure from the dexter surface to the sinister surface;

wherein the coronal channel is positioned such that the coronal channel passes directly through the sagittal channel;

wherein a fifth end of the coronal channel forms an aperture through the canted surface;

wherein a sixth end of the coronal channel forms an aperture into the sagittal channel;

wherein the center axis of the coronal channel perpendicularly intersects the center axis of the sagittal channel.

16. The multi-purpose cushioning structure according to claim 15 wherein the inferior channel has a prism structure;

wherein the center axis of the inferior channel is parallel to the coronal direction of the foam block structure;

wherein the inferior channel is formed through the entire structure of the foam block structure from the dexter surface to the sinister surface;

wherein the inferior channel is positioned such that the inferior channel passes directly through the sagittal channel;

wherein the inferior channel is formed such that the inferior lateral face of the inferior channel forms an opening in the posterior surface;

wherein a fifth end of the inferior channel forms an aperture through the canted surface;

wherein a sixth end of the inferior channel forms an aperture into the sagittal channel;

wherein the center axis of the inferior channel perpendicularly intersects the center axis of the sagittal channel;

wherein the plurality of arms insert into the inferior channel.

17. The multi-purpose cushioning structure according to claim 16 wherein the foam block structure is formed from a polyurethane foam.

* * * * *